United States Patent [19]

Rinke

[11] Patent Number: 4,889,245

[45] Date of Patent: Dec. 26, 1989

[54] POP CAN TRANSPORT DEVICE

[76] Inventor: Richard A. Rinke, 737 Charlesina St., Rochester, Mich. 48065

[21] Appl. No.: 286,615

[22] Filed: Dec. 19, 1988

[51] Int. Cl.[4] ..... B65D 65/00

[52] U.S. Cl. ..... 211/49.1; 206/427

[58] Field of Search ..... 211/49.1, 59.2, 71, 211/87, 88, 194; 206/430, 427, 429, 162; 294/87.2, 159, 161; 312/45

[56] References Cited

U.S. PATENT DOCUMENTS

| | | | |
|---|---|---|---|
| 1,054,707 | 3/1913 | Mertens | 211/59.2 |
| 2,637,475 | 5/1953 | Gialanella | 294/87.2 X |
| 2,821,299 | 1/1958 | Crary | 206/162 |
| 3,251,622 | 5/1966 | Miller | 294/159 X |
| 3,738,278 | 5/1973 | Kerrigan et al. | 294/87.2 X |
| 4,493,127 | 1/1985 | Blanke, Jr. et al. | 294/27.1 X |
| 4,611,718 | 9/1986 | Cohn et al. | 211/49.1 |
| 4,735,313 | 4/1988 | Schoenberg | 206/427 |

*Primary Examiner*—Alvin C. Chin-Shue
*Attorney, Agent, or Firm*—Dykema Gossett

[57] ABSTRACT

A pop can transport device comprises a web with a transverse partition centrally thereof and opposed pairs of aligned transversely concave end wall sections extending from the ends of the web defining a plurality of tubes, each tube having an expansive opening along its length and a stop at one end. Each tube is adapted to receive and retain a stack of pop or beverage cans.

8 Claims, 1 Drawing Sheet

POP CAN TRANSPORT DEVICE

FIELD OF THE INVENTION

The invention relates to a pop can transport device and more particularly to one or a pair of symmetrical molded sections connected together adapted to receive and transport a plurality of stacks of beverage cans.

RELATED PATENT APPLICATION

The present application is related to and represents an improvement over my co-pending U.S. patent application, Ser. No. 158,648 filed Feb. 22, 1988, now abandoned, relating to a pop can storage device.

BACKGROUND OF THE INVENTION

Previously, pop cans are transported in cardboard or plastic cartons, some having a handle, sometimes referred to as a four, six or eight pack and wherein a plurality of cans may be stored and transported side-by-side in a group within the transport or storage device. The difficulty with present pop can transport devices is the limitation in the number of cans normally enclosed therein such as four, six or eight. Previously, empty pop cans are placed either in the original container, if available, or within a paper or plastic bag and transported back to a store for redemption or returned for handling in a haphazard manner. There is to be a need for pop can transport device which will store a series of vertical stacks of pop cans for display, for transport and for storage of the empty cans and for their convenient return for redemption.

THE PRIOR ART

Devices for holding a plurality of coins, cans game chips, paper cup dispensers or jar organizers are shown in one or more of the following U.S. patents:

| PAT. NO. | INVENTOR | DATE ISSUED | INVENTION |
|---|---|---|---|
| 198,536 | H. E. Dewey | December 25, 1877 | Coin Holder |
| 2,212,129 | E. H. Rust | August 20, 1940 | Can Rack |
| 2,645,352 | W. B. Petzold | July 14, 1953 | Game Chip Holder |
| 4,132,380 | Ronald Pastore | January 2, 1979 | Clip for Cup Dispenser |
| 4,305,512 | James F. Mackenzie | December 15, 1981 | Jar Organizer |
| 4,678,087 | Randall A. York | July 7, 1987 | Modular Ski Rack |

SUMMARY OF THE INVENTION

An important feature of the present invention is to provide a pop can transport device adapted for transporting any kind of beverage can, empty or full, which includes one or a pair of symmetrical elongated sections and with each section constructed so as to provide a plurality of elongated tubes arranged side-by-side with an expansive opening along the length of each tube and including a stop at the bottom so that the respective tubes are adapted to store and retain and transport a stack of pop cans.

As another feature, the pop can transport device includes a pair of laterally interconnected first and second symmetrical sections and wherein each section has an elongated flat web and an elongated transverse partition extending from opposite sides of the web centrally thereof, together with opposed pairs of aligned elongated transversely concave end wall sections which extend from the ends of the web on its opposite sides to define with the partition and the web a plurality of open ended tubes. Each tube is adapted to retain, store or transport a stack or a plurality of aligned pop cans.

As another feature, the transport device includes a handle which centrally overlies one or a pair of such sections with the sections interconnected and is connected thereto.

As another feature, the handle includes depending pairs of opposed anchor flanges which extend over one end of the webs of each section and are secured thereto.

As another feature, each end wall section includes a central portion parallel to the partition, an angular connector which extends between one side of the central portion and the web and a flexible end flange upon the other side of the central portion and wherein the flange and adjacent partition together define a yieldable throated opening for the lateral reception of pop cans thereinto.

These and other features and objects will be seen from the following specification and claims in conjunction with the appended drawings.

THE DRAWINGS

It will be understood that the above drawing illustrates merely a preferred embodiment of the invention, and that other embodiments are contemplated within the scope of the claims hereafter set forth.

DETAILED DESCRIPTION OF AN EMBODIMENT OF THE INVENTION

Figure 1:
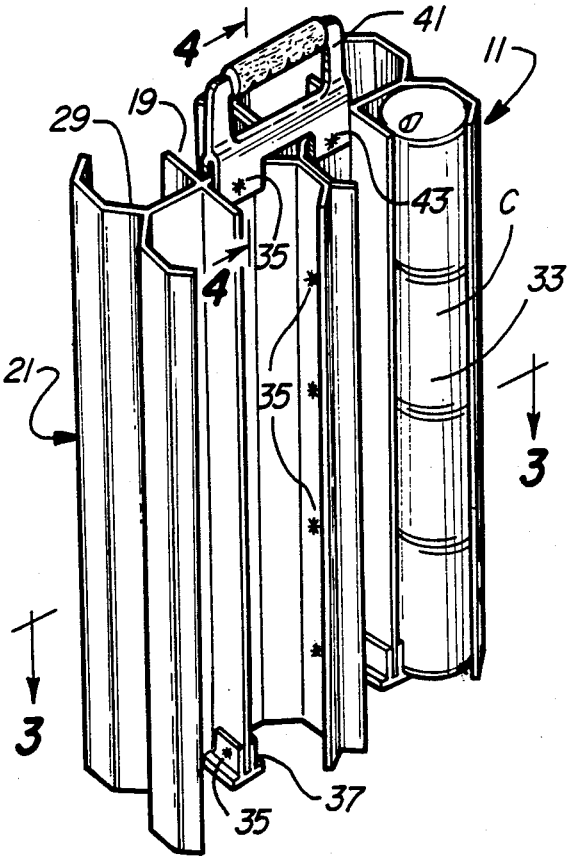
FIG. 1 is a front perspective view of the present pop can transport device.
Figure 2:
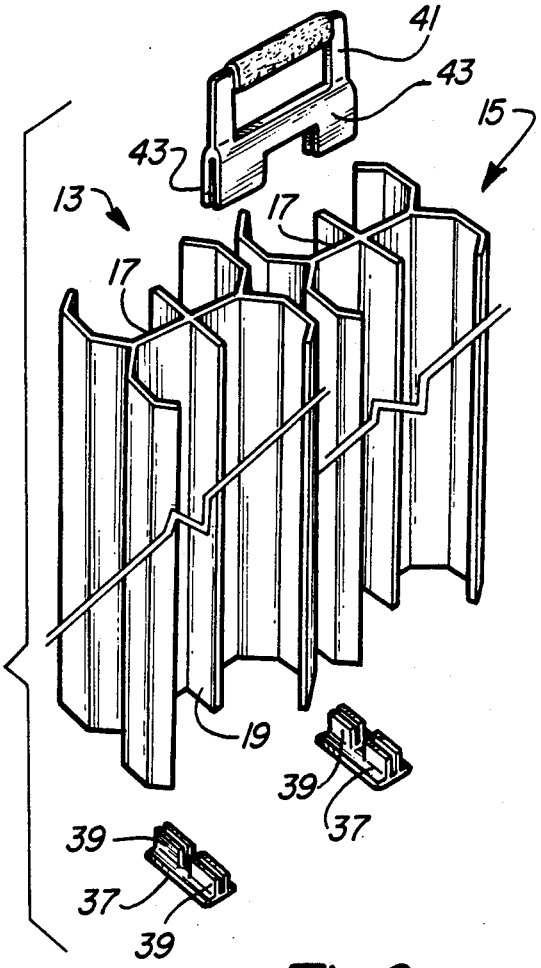
FIG. 2 is an exploded perspective view thereof.

Referring to the drawing, present pop can transport device, generally indicated at 11, FIG. 1 includes first and second symmetrical sections 13 and 15, FIG. 2, preferably of a molded plastic construction.

Each of the sections 13 and 15 includes an elongated flat web 17 which is generally upright. An elongated transverse partition 19 extends from opposite sides of the web centrally thereof and is connected thereto.

Opposed pairs of aligned elongated transversely concave end wall sections 21 extend from the opposite upright ends of the web 17 on its opposite sides. Said end wall sections define with the transverse partition 19 a plurality of elongated open ended tubes 29.

Figure 3:
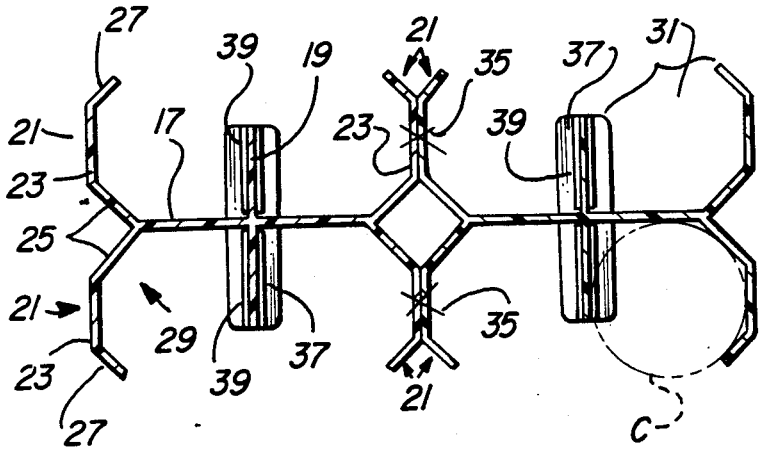
FIG. 3 is a plan section taken in the direction of arrows 3-3 of FIG. 1, on an increased scale.
Figure 4:
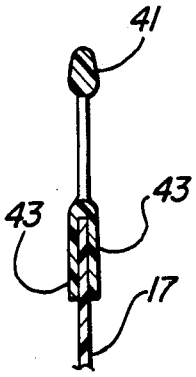
FIG. 4 is a fragmentary section taken in the direction of arrows 4-4 of FIG. 1, on an increased scale.

Each of the end wall sections 21 includes a generally upright elongated central portion 23, FIG. 3, and extending therefrom an elongated angular connector 25 which extends between one side of the central portion 23 and merges with the end of the web 17. Each end wall section includes an elongated end flange 27 which extends along the other side of the central portion 23. The respective end flanges 27, FIGS. 1, 2 and 3 define with the adjacent transverse partition 19 a plurality of can storage tubes 29 arranged in groups. Each of the can storage tubes includes an upright can clearance slot 31 which is defined by the outer edge of the corresponding end flange 27 and the adjacent partition 19. The respective end flanges 27 are yieldable, thus defining an expansive opening and clearance slot 31 shown in FIG. 3 which is of a dimension less than the diameter of a can C and is expansible to permit its lateral insertion into the tube 29 for stacking therein, FIG. 1. Alternately, the respective can C may be stacked within a particular tube 29 by insertion into the upper end thereof.

In the illustrated embodiment flanges 25 and 27 are inclined at a 45 degree angle to the central portion 23.

In an illustrative embodiment the respective symmetrical first and second sections 13 and 15 forming a part of the pop can transport device are laterally interconnected by the engagement of the corresponding central portions 23 of the respective end wall sections with each other and with a series of longitudinally spaced welds 35. In the illustrative embodiment such welding is by ultrasonic welding along the height of the adjacent mating central portions 23 of adjacent symmetrical sections 13 and 15.

Suitable stop means are employed at the bottom of the respective tubes 29 for holding the stacks of cans C therein. In the illustrative embodiment there is provided for each of the sections 13 and 15 a transverse stop plate 37 which extends along the underside of the partition 19 and partly into the bottom portion of each of the respective tubes 29. The respective stop plates 37 include longitudinally spaced pairs of upstanding mount flanges 39. These flanges receive and extend over lower portions of the partition 19 and are suitably secured thereto such as by ultrasonic welding as at 35, FIG. 1. The stop plates 37 are flexible and yieldable. Normally, the stop plate supports a stack of cans. On application of limited axial pressure, a stop plate 37 will yield to permit removal of a stack of cans from the bottom of each tube.

Overlying the pair of laterally assembled symmetrical first and second sections 13 and 15 there is provided a molded handle 41 preferably of plastic material. Said handle includes depending therefrom longitudinally spaced opposed pairs of anchor flanges 43. These flanges receive upper edge portions of the adjacent webs 17 and are suitably secured thereto such as by ultrasonic welding for illustration as at 35, FIG. 1.

In the illustrative embodiment there is disclosed a pair of laterally interconnected first and second symmetrical sections 13 and 15. It is contemplated that a pop can transport device which includes the use of four tubes may be provided by a single section 13. In that case the corresponding handle 41 would overly such single section with its depending anchor flanges 43 receiving upper end portions of the web 17 and connected thereto as by ultrasonic welding at 35.

In the disclosure, essentially the device is referred to as a pop can transport device. It is contemplated as equivalent that the present transport device may be used for the transport of any type of beverage can of cylindrical form which may be arranged in vertical stacks such as shown at 33, FIG. 1.

While ultrasonic welding is disclosed, it is contemplated that there could be a dielectric bond or a suitable adhesive employed which would fixedly mount the handle 41 to their respective sections 13 and 15 or to either section if the handle is to be used singly on one section.

Similarly, the stop plates 37 underlie the corresponding partitions 19 with portions thereof projecting into the adjacent tubes 29 on opposite side thereof in order to serve as a positive stop limiting downward movement of the cans within their respective tubes.

Having described my invention reference should now be made to the following claims.

I claim:

1. A modular pop can transport device comprising:

a pair of laterally interconnected first and second symmetrical sections;

each section including an elongated flat web extending longitudinally;

an integral elongated transverse partition extending perpendicularly from opposite sides of said web centrally thereof;

opposed pairs of aligned, elongated, transversely concave end wall sections extending from the ends of said web upon its opposite sides, defining with said partition and said web a plurality of elongated open-ended tubes, with each tube having an elongated, throated, expansive opening along its length, each of said end wall sections having a first portion extending from said web and longitudinally away from said partitions, a second portion extending from said first portion at a first corner and perpendicular to said web, and a third portion extending from said second portion at a second corner and longitudinally towards said partition, said corners defining angles;

each tube adapted to receive and retain a stack of pop cans; and can stop means connected to one end of said partition and extending into each tube;

said end wall sections being relatively yieldable in comparison to said partition, such that said end tubes are yieldable outwardly away from said partitions to allow a pop can within any one of said tubes to be removed without removing any other pop can stacked therewith; and said first and second symmetrical sections being connected to each other at respective ones of said second portions and by a handle centrally overlying said first and second sections and connected thereto, said stop means including a stop plate underlying said web and partition; spaced pairs or opposed aligned mount flanges upon said stop plate extending over the one ends of said partition and secured thereto.

2. In the pop can transport device of claim 1, further comprising said handle including longitudinally spaced depending pairs of opposed anchor flanges extending over one end of said webs and secured thereto.

3. In the pop can transport device of claim 2, further comprising said securing including ultrasonic welding of said anchor flanges to said webs.

4. In the pop can transport device of claim 1, further comprising adjacent end wall sections of said first and second symmetrical sections being in engagement and secured together by a plurality of ultrasonic welds.

5. In the pop can transport device of claim 1, further comprising each end wall section including a central portion parallel to said partition, an angular connector between one side of the central portion and said web, and a flexible end flange upon the other side of said central portion.

6. In the pop can transport device of claim 5, further comprising said end flange and adjacent partition defining said throated opening.

7. In the pop can transport device of claim 6, the corresponding end flange of each tube yieldably receiving a pop can for projection thereinto.

8. In the pop can transport device of claim 1, further comprising said stop plate being yieldable.

* * * * *